US005673626A

United States Patent [19]

Jaeggi

[11] Patent Number: 5,673,626

[45] Date of Patent: Oct. 7, 1997

[54] EQUIPMENT FOR CLEANING RAILWAY TRACKS

[75] Inventor: Jean-Pierre Jaeggi, Geneva, Switzerland

[73] Assignee: Speno International SA, Geneva, Switzerland

[21] Appl. No.: 618,549

[22] Filed: Mar. 20, 1996

[30] Foreign Application Priority Data

May 16, 1995 [CH] Switzerland ..... 1424/95

[51] Int. Cl.[6] ..... E01H 8/00

[52] U.S. Cl. ..... 104/279; 15/55

[58] Field of Search ..... 104/279; 15/54, 15/55, 340.4, 312.1, 340.3, 384

[56] References Cited

U.S. PATENT DOCUMENTS

| | | | |
|---|---|---|---|
| 815,308 | 3/1906 | Perry | 15/55 |
| 4,741,072 | 5/1988 | Wilkerson | 15/55 |
| 5,402,547 | 4/1995 | Theurer | 104/279 |
| 5,579,553 | 12/1996 | Holley | 104/279 |

FOREIGN PATENT DOCUMENTS

| | | | |
|---|---|---|---|
| 0 378 025 | 7/1990 | European Pat. Off. . | |
| 485810 | 5/1992 | European Pat. Off. | 15/54 |
| 1 759 817 | 7/1971 | Germany . | |
| 89 13 287.4 | 2/1990 | Germany . | |

OTHER PUBLICATIONS

A drawing concerning a machine made by NEU Process International, described on p. 1 of the specification, No. 27 90 2047 B. (No date).

*Primary Examiner*—Mark T. Le
*Attorney, Agent, or Firm*—Young & Thompson

[57] ABSTRACT

An equipment for cleaning automatically railway tracks, including a box (4) guided and carried by rails, designed for installation under a railway vehicle and which can be lifted by means of jacks (6, 6'). The box includes two shaped brushes (13, 13') driven in rotation, placed one in front of the other in the direction of the axis of the rail. A brush (14) arranged between each rail and the axis of the track makes it possible to project debris in the direction of the shaped brushes (13, 13'). The shaped brushes (13, 13') rotate in opposite directions with respect to each other and drive the debris into the upper part of the box to be subsequently sucked into a suction conduit (10). Receiving drawers (16, 16') make it possible to recover debris which are too heavy to be sucked away.

16 Claims, 5 Drawing Sheets

EQUIPMENT FOR CLEANING RAILWAY TRACKS

Railway tracks on which surface trains, underground trains and tram cars run, are constantly littered by various debris thrown away by the passengers, in particular in stations. These debris can be of various types including tickets, packaging boxes, bottles, metal cans, paper, etc. Furthermore, the tracks also receive the debris from the reprofiling of rails which is generally carried out by grinding, milling or planing and leaves behind chips or dust on the track.

The manual cleaning, which is still practiced sometimes in stations, is slow, dangerous and expensive. This method of cleaning, which cannot be applied to the whole length of the tracks, is progressively being given up also in stations and replaced by automatic cleaning making use of machines.

There are several machines for cleaning railway tracks, for example that described in document DE-27902047 which consists of a central box without a bottom, which is supported and guided by the rails. This box is put under a depression by means of powerful air suction devices followed by filters for collecting the debris. These machines are not satisfactory, since they are effective only for light items, such as paper, tickets, etc, but cannot be used for recovering cans and bottles, or metal chips and dust. Furthermore, these machines suffer the drawback of having very high power requirements for operating the air suction devices, in the order of 100 KW.

An objective of the present invention is to allow an automatic cleaning, by means of a machine, of the tracks used by surface or underground trains, or by tram cars, within and outside stations, and which makes it possible to pick up both light debris such as paper, tickets, etc, and heavy debris such as bottles, metal cans, as well as the dust and chips produced by the reprofiling of rails.

Another objective of the invention is to replace the manual picking up of debris by a mechanical operation, which is faster, less expensive and above all without danger for the railway staff.

A further objective of the invention is to reduce the bulk of the track cleaning machine or device, and above all, to reduce the energy requirements and consumption.

The object of the present invention is an equipment for the mechanical cleaning of tracks used by surface trains, underground trains, tram cars funicular trains, etc, which would tend to obviate the above-mentioned drawbacks of existing machines and which is characterized by the features claimed herein.

Owing to these characteristic features and in particular to the combined action of shaped brushes and of an air suction device, an equipment is obtained which is compact and which allows the removal of all the debris found on a railway track, whatever may be their nature and/or their position on the track, while having substantially lower power requirements than existing machines.

The annexed drawing illustrates schematically and by way of example two embodiments of equipment for cleaning railway tracks according to the invention.

Figure 1:
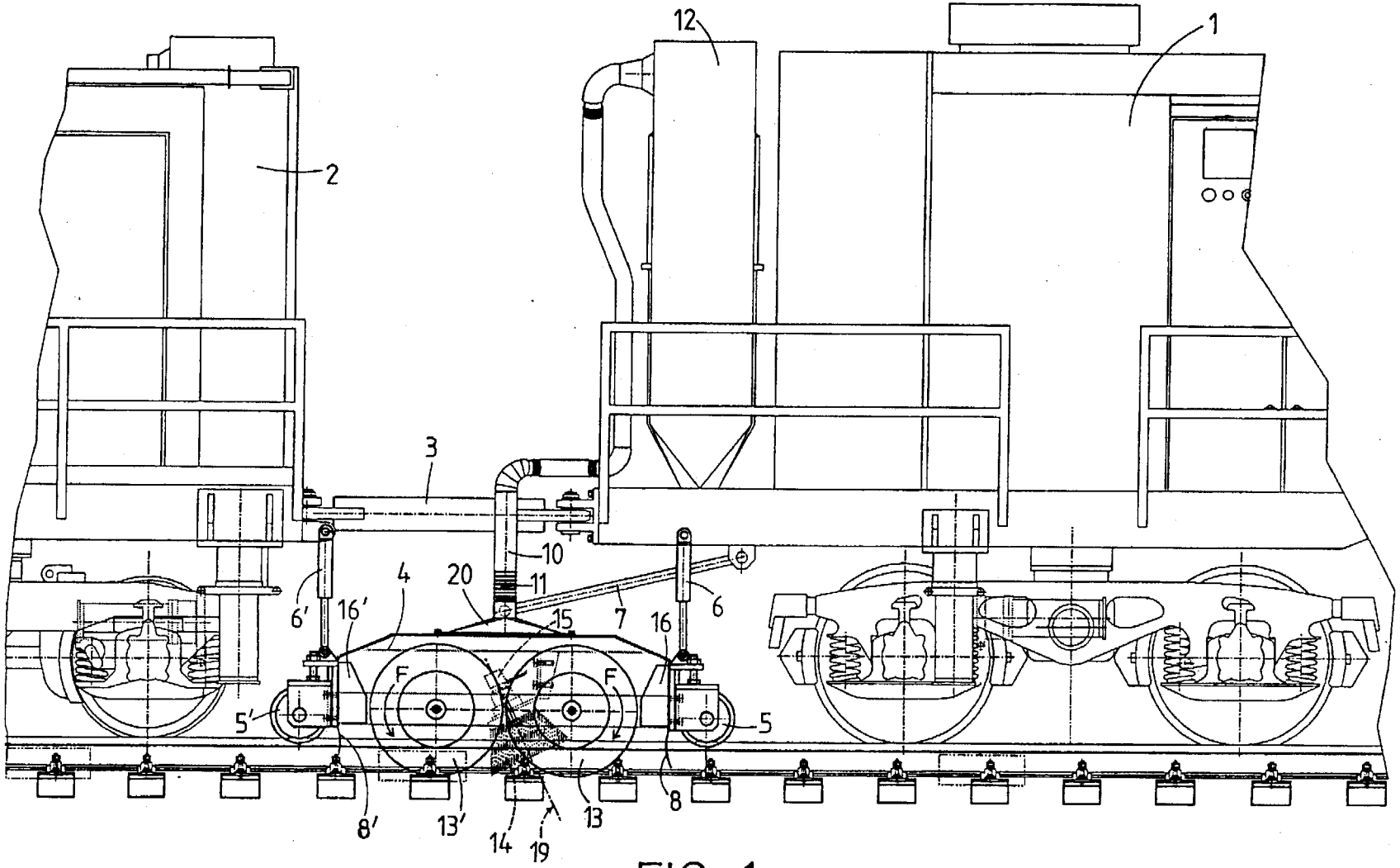
FIG. 1 illustrates in part a motor unit of a service train coupled to a carriage, with the motor unit carrying a part of the cleaning equipment whereas another part thereof is placed between the motor unit and the wagon, while being pulled along the track by said motor unit.

The right-hand part of FIG. 1 shows the rear portion of a motor railway unit 1 pulling along a railway track a carriage 2 via a coupling 3. The cleaning equipment for the track is situated, in this embodiment, between the motor unit 1 and the carriage 2. This cleaning equipment is provided as a box 4 without a bottom, guided and supported by the rails by means of rollers 5, 5'. The box 4 is connected to the frame of the back part of the motor unit 1 and to the frame of the front part of the carriage, by means of lifting members, 6, 6', such as hydraulic jacks. The box 4 is driven along the track, by a drawbar 7 attached to the motor unit 1. The hydraulic jacks 6, 6' make it possible to lift the box 4, for example when the box is not to be used. A suction is created in box 4 by an air suction device arranged in a container for debris 12 positioned on the motor unit 1. The air suction device includes a cyclone associated with an appropriate filter which makes it possible to retain the heavier debris first, and then the dust. The air suction device is connected to the box 4 via an air suction conduit 10 including bellows 11 which make it possible to accommodate any relative movements between the box 4 and the motor unit The upper part of the box 4 receives a concave part 20 forming an air suction hood which makes it possible to concentrate the débris at the inlet of the air suction conduit 10. Rubber skirts 8, 8' surround the box 4 in its lower part and facilitate the creation of a suction within the same by increasing its airtightness.

Two shaped brushes 13, 13' of which the bristles are generally made of a plastic material or of steel, are arranged inside the box 4, one behind the other, in the axial direction of the rail, in such a manner as to saddle each rail. These brushes 13, 13' are driven in rotation by motors and rotate in the opposite directions to each other, as indicated by the arrows F. A brush 14 of a smaller size and driven in rotation by a motor 15 is positioned between the rail and the axis of the track. In the working position, the axis of rotation 19 (FIG. 2) of the brush 14 is at an acute angle with a vertical axis perpendicular to the plane formed by the rails. In this working position, only one part of the periphery of the brush 14 is in contact with the ballast. This brush can be tilted by a device which will be described with reference to FIG. 2 and which makes it possible to bring the axis of rotation of the brush into a plane which is substantially vertical, so that the brush 14 is not any more in contact with the ballast. The box 4 includes furthermore two drawers for receiving the debris 16, 16' fastened against the frame of the box respectively at the front and at the back of the latter, in the vicinity of the guider rollers 5, 5'. The operation of the device will now be explained with reference to FIG. 2.

The brushes 13, 13' are driven in rotation in opposite directions to each other, so that their parts in contact with the rail move one towards the other. In this manner, the debris situated in the vicinity of one rail are first driven into an area situated between the point of contact between the brushes and the rail, and then projected towards the upper part 20 of the box. The lighter debris, once they are in this area, are sucked up by the air suction device and are evacuated by the conduit 10. The heavier debris, such as metal residues from the grinding or more bulky items such as bottles for example are not sucked up but driven by the movement of the brushes 13, 13' and fall into the lateral recovery drawers 15, 15'. The central brush 14 has for function to project the debris situated in the space defined by the medial longitudinal axis of the track and a rail, in the direction of the brushes 13, 13' which drive them towards the upper zone of the box, as described above. As the axis 19 of the brush 14 forms an acute angle with the vertical axis in the working position, only one part of the periphery of the brush 14 is in contact with the ballast. In this manner, by adapting the direction of rotation of the brush according to whether it is tilted forwards or backwards, the debris are projected tangentially at the periphery of the brush 14 in the direction of the space comprised between the point of contact of the brushes 13, 13' and the rail. Thus, it is possible with this equipment to recover both debris located in the immediate vicinity of the rails and those between the rails of the track.

Owing to the action of the brushes 13, 13', which make it possible to bring the debris into the upper area of the box and therefore directly in vicinity of the air suction conduit 10, it is not necessary to have at one's disposal a high-powered air suction device as in existing machines. By way of example, a power of about 20 KW is adequate for collecting the debris.

Figure 2:
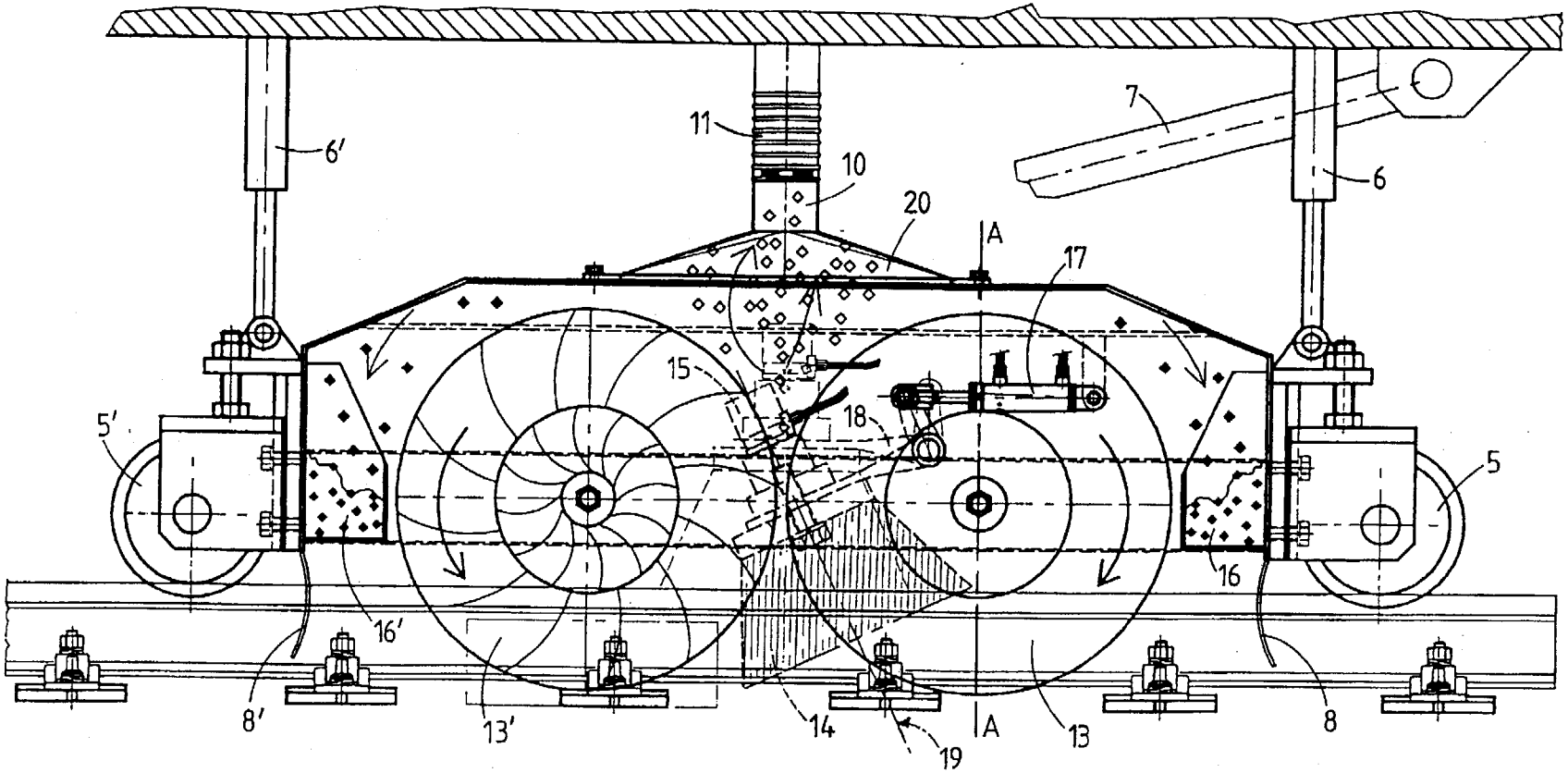
FIG. 2 illustrates at an enlarged scale the part of the cleaning equipment which is drawn along the railway in an embodiment where the equipment is placed in a drawn carriage.

As can be seen in FIG. 2, the angular position of the central brushes 14 ran be adjusted by means of hydraulic jacks 17, of which the cylinder is rigidly connected to the frame of the box 4 and of which the rod actuates an intermediate piece 18 carrying the brush 14. By actuating the hydraulic jack 17, one modifies the angle between the axis of rotation 19 of the brush 14 and a vertical axis perpendicular to the axis of the track. By adjusting this position, one can optimise the projecting of the debris in the direction of the brushes 13, 13' having the larger diameter and possibly compensate the effects of an uneven wear of the brushes 14.

Figure 3:
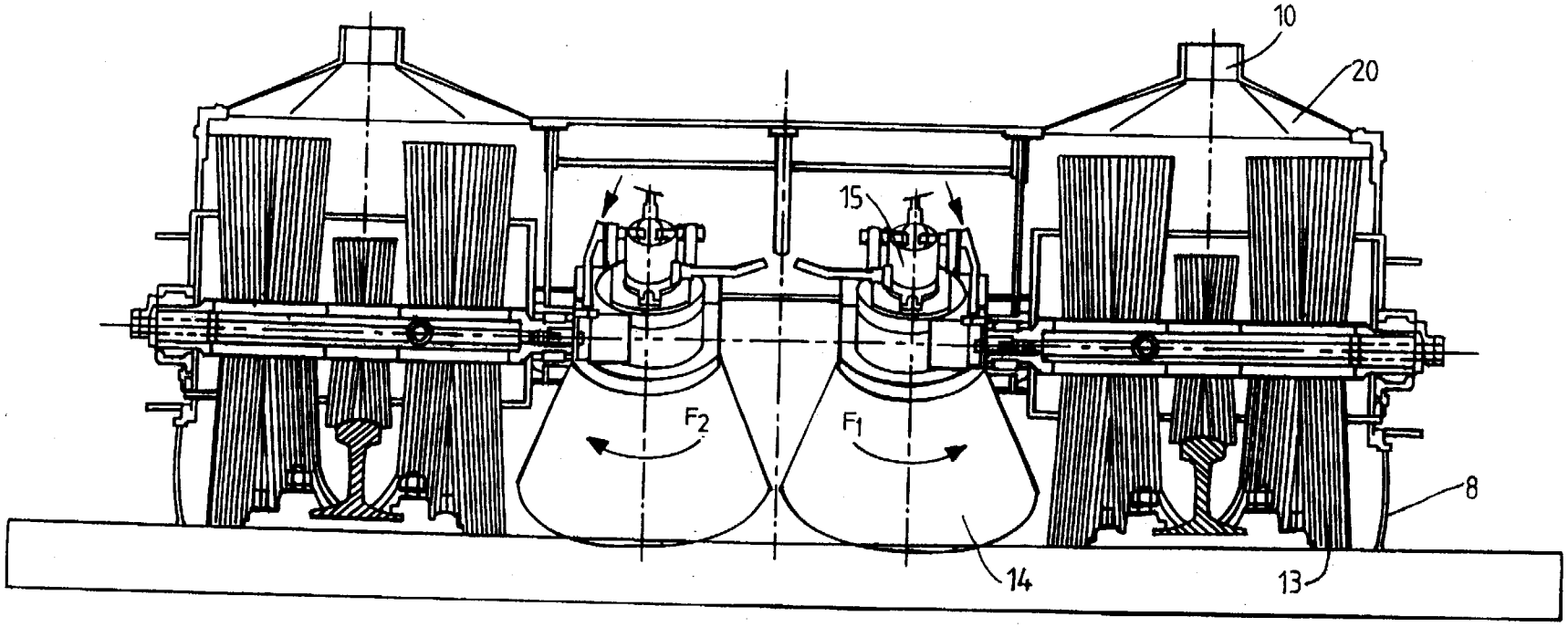
FIG. 3 is a cross-sectional view along line A—A of FIG. 2.

FIG. 3 shows in cross-section how the brushes 13, 13' are conformed. These shaped brushes have on each side of the rail head bristles of a sufficient length for reaching the ground in the working position, whereas the central part of the brush, which is in direct contact with the rail head, carries bristles of a length adapted to just reach said rail head in the working position. The arrows F1 and F2 of FIG. 3 indicate the direction of rotation of the central brushes 14, which direction of rotation is selected so that these brushes 14 fulfil their function, namely bring the debris situated at the center of the track towards the brushes 13, 13' to ensure their projection towards the upper suction zone 10 of the box 4.

Figure 4:
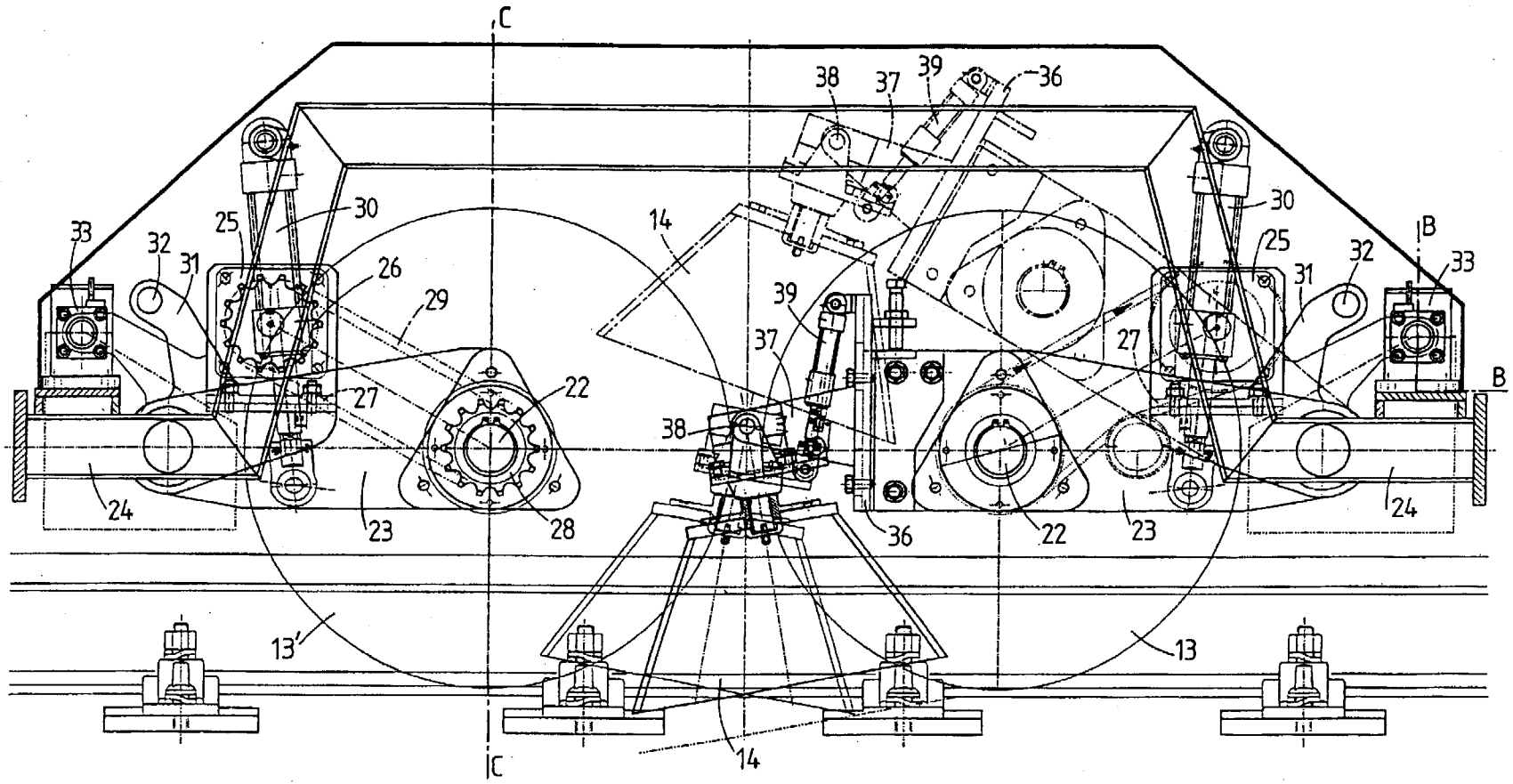
FIG. 4 is a view similar to FIG. 2 of a second embodiment of the cleaning equipment.
Figure 5:
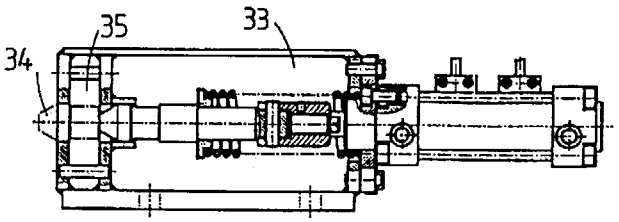
FIG. 5 is a cross-sectional view along line B—B of FIG. 4.
Figure 6:
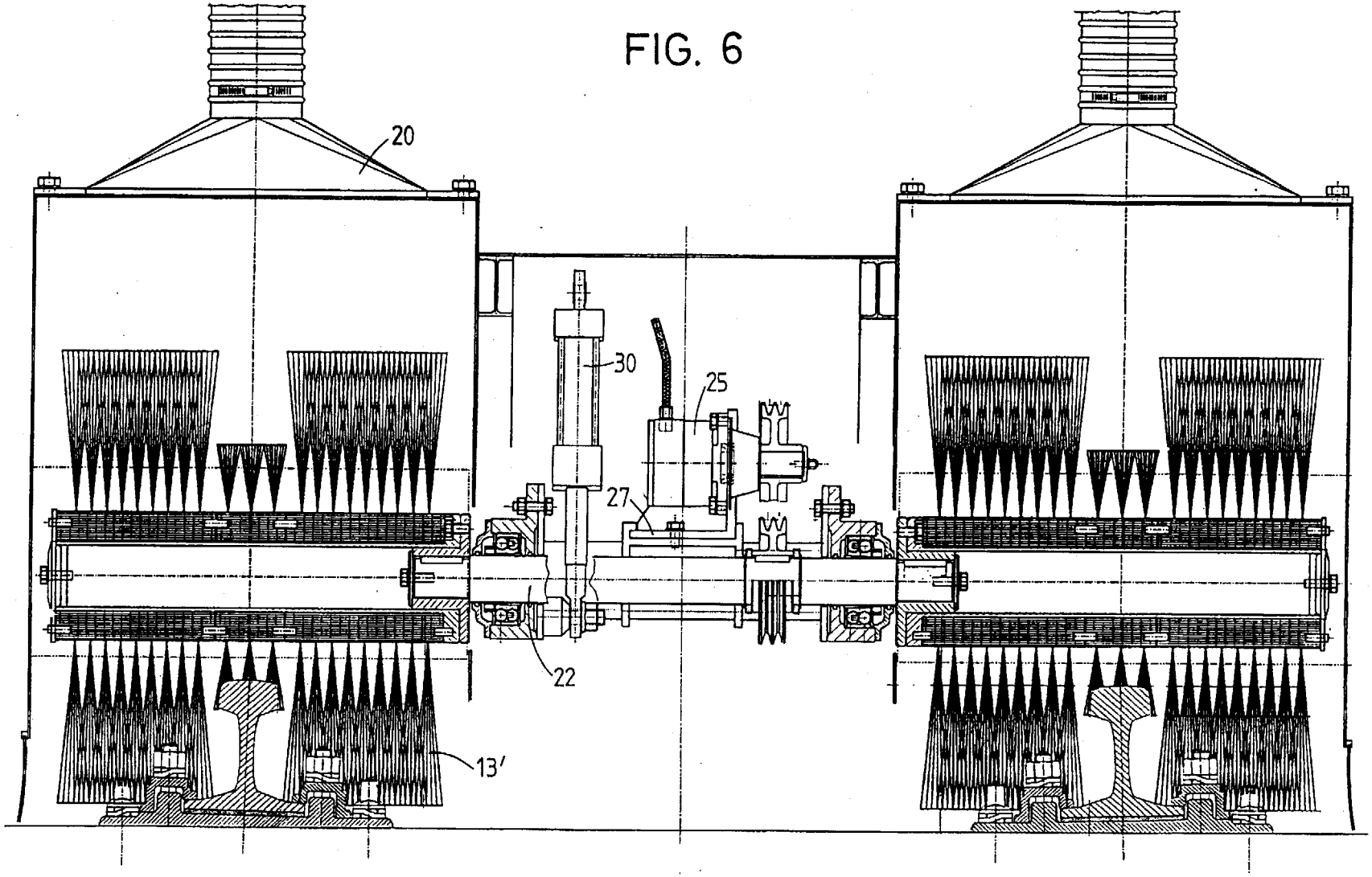
FIG. 6 is a cross-sectional view along line C—C of FIG. 4.

FIGS. 4, 5 and 6 illustrate a second embodiment of the cleaning device for railway tracks of the present invention. The principle of operation is identical to that of the first embodiment, however both the brushes 13, 13' and the brush 14 are arranged in such a manner that they can be lifted during operation on the track. The front and the back brushes, respectively 13 and 13', can be lifted to the upper position independently of each other. The central brush 14 is rigidly connected to the frame carrying the front brush 13 and can hence be lifted with the brush 13. This arrangement offers the advantage that one brush or the other can be lifted, for example to avoid an obstacle on the track, without having to lift the whole box by means of the hydraulic jacks 6, 6' Incidentally, detectors (not represented) for obstacles, of a known type, can be included into the equipment and ensure the automatic lifting of the brushes 13, 14 or 13' in the occurrence of an obstacle on the track.

With reference to FIG. 4, the brushes 13' are mounted around an axis 22 carried by a support member 23. This support member 23 is pivoted at its end opposite to the axis of the brush around a frame 24 rigidly connected to the box 4. A motor 25 provided with a driving pinion 26 is fastened to a plate 27 arranged on the support part 23. A second pinion 28 on the axis of the brush 22 makes it possible to drive in rotation the same by means of a chain or of a toothed belt 29. A jack 30, of which the cylinder is rigidly connected to the frame 24 and of which the rod is fastened in the support member 23, makes it possible, when actuated, to lift the support member 23 and hence the brush 13' into a high position, indicated by a dotted line on the right-hand side of FIG. 4. The support member 23 exhibits a protrusion 31 with a through hole 32. A locking member 33 fastened to a frame 24 includes an axis 34 sliding against the action of a resilient member (FIG. 5). When the support member 23 is in the lifted position, the protrusion 31 engages into a hollow 35 of the locking member 33 and the axis 34 engages inside the through hole 32 of the protrusion 31, thus ensuring a reliable locking of the support member 23.

The arrangement of the brushes 13 is identical to that described above. The support member 23 further includes at its end close to the axis 22 of the brush 13, a fastening plate 36 carrying the brush 14. The brush 14 is arranged to rotate on an axis 38 of a holding member 37. A jack 39, of which the cylinder is connected rigidly to the plate 36 and of which the rod is connected to the brush 14, makes it possible to vary the angular position of said brush in a vertical plane parallel to the axis of the track.

The rotational speed of the brushes 13, 13' which rotate in opposite directions to each other ran be the same for each brush or on the contrary these rotational speeds ran be different. It is also possible to provide a control means (not illustrated) for controlling the speed of the brushes 13, 13', 14 according to the speed of operation of the equipment along the track, the control making it possible to ensure that the tangential speed at the periphery of each brush 13, 13' with respect to the rail remains constant, whatever the speed of motion of the equipment along the track.

The central brush 14 is illustrated on the drawings by a single brush of a size sufficient to span the space situated between the axis of the track and each rail. It is obvious that other arrangements are possible, for example including several brushes 14 of a smaller size to cover effectively the surface situated between the axis of the track an each rail.

For reasons of place, the equipment was shown in FIG. 1 between a motor unit i and a carriage 2, but this equipment can of course be placed, owing to its small bulk, into a self-contained mobile unit or be incorporated into a chariot drawn along the track.

I claim:

1. A device for cleaning railway tracks comprising:

at least one hood for being guided along a rail of the tracks and adapted to be attached to a suction apparatus;

at least two first brushes within said hood adjacent the rail and aligned one in front of the other along an axis of the rail and which are connected to means for rotating the first brushes in opposite directions so that portions of said two first brushes adjacent said rail move towards each other; and at least one second brush adapted to be carried between the tracks and said second branch being angled so that a first portion of its periphery contacts a ballast between the tracks, said second brush being connected to means for rotating the second brush in a manner that the first portion of its periphery moves toward said two-first brushes, whereby debris between the tracks is projected by said second brush toward said two first brushes.

2. The device of claim 1, wherein said hood comprises a wheel for running on the rail, and wherein said device further comprises a strut member for attachment to a railway vehicle, and a drawbar for attachment to the vehicle and for guiding said device along the tracks.

3. The device of claim 1, further comprising suction apparatus for sucking air from said hood, said suction apparatus comprising a cyclone for recovering heavy debris and filters for recovering finer debris.

4. The device of claim 1, wherein said two first brushes are rotated at substantially the same rotational speed when said device is operating.

5. The device of claim 1, wherein said first and second brushes are rotated at rotational speeds related to a speed of said device.

6. The device of claim 5, wherein the rotational speeds of said two first brushes are different.

7. The device of claim 5, wherein the rotational speeds of said two first brushes are controlled so that their tangential speeds adjacent the rail are the same regardless of the speed of said device.

8. The device of claim 1, wherein said hood further comprises a peripheral skirt.

9. The device of claim 1, wherein said hood further comprises a drawer at an interior end thereof for recovering debris.

10. The device of claim 1, further comprising supports for said first and second brushes which are pivotable with respect to a frame and a lifting member for pivoting said first and second brushes with respect to said frame for lifting said first and second brushes.

11. The device of claim 10, further comprising a locking device for holding said first and second brushes in a position with respect to said frame.

12. The device of claim 10, further comprising an obstacle detector for initiating lifting of said first and second brushes.

13. The device of claim 1, further comprising means for adjusting an angle of said second brush.

14. The device of claim 1, wherein said first and second brushes comprise bristles of at least one of plastic and steel.

15. The device of claim 1, wherein said at least one hood comprises two hoods, each adapted to be guided along a different rail of the tracks and having at least one set of said two first brushes, and said at least one second brush comprises to second brushes each for projecting debris into a different one of said two holds.

16. The device of claim 1, wherein said second brush is adapted to be carried between the rail and a medial axis of the tracks.

* * * * *